US009429063B2

(12) United States Patent
Youm et al.

(10) Patent No.: US 9,429,063 B2
(45) Date of Patent: Aug. 30, 2016

(54) CYLINDER BLOCK

(71) Applicant: Hyundai Motor Company, Seoul (KR)

(72) Inventors: Chul-Jun Youm, Uijeongbu-si (KR); Soon-Hyon Hwang, Hwaseong-si (KR); Jae-Kwon Lee, Suwon-si (KR); Jong-Hyuck Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/477,659

(22) Filed: Sep. 4, 2014

(65) Prior Publication Data

US 2015/0260079 A1 Sep. 17, 2015

(30) Foreign Application Priority Data

Mar. 14, 2014 (KR) ..... 10-2014-0030035

(51) Int. Cl.

| | |
|---|---|
| ***F02B 75/18*** | (2006.01) |
| ***F01P 3/02*** | (2006.01) |
| ***F02F 1/02*** | (2006.01) |
| *F02B 75/22* | (2006.01) |
| *F02F 1/10* | (2006.01) |
| *F02F 1/14* | (2006.01) |

(52) U.S. Cl.

CPC .. *F01P 3/02* (2013.01); *F02F 1/02* (2013.01); *F02F 1/10* (2013.01); *F02B 75/22* (2013.01); *F02B 2075/1816* (2013.01); *F02F 1/108* (2013.01); *F02F 1/14* (2013.01)

(58) Field of Classification Search

CPC ..... F01P 3/02; F02F 1/108; F02F 1/14; F02B 2075/1816; F02B 75/22

USPC ..... 123/41.74

See application file for complete search history.

(56) References Cited

U.S. PATENT DOCUMENTS

| | | | | |
|---|---|---|---|---|
| 7,013,948 | B1 * | 3/2006 | Grebe et al. | 164/137 |
| 2012/0132157 | A1 * | 5/2012 | Matsuki et al. | 123/41.79 |

FOREIGN PATENT DOCUMENTS

| | | | |
|---|---|---|---|
| JP | 2002-115600 | A | 4/2002 |
| JP | 2002-227715 | A | 8/2002 |
| JP | 2002-332911 | A | 11/2002 |
| JP | 2005-256661 | A | 9/2005 |
| JP | 2006-90195 | A | 4/2006 |
| JP | 2007-315195 | A | 12/2007 |
| JP | 2008-128054 | A | 6/2008 |
| JP | 2009-257218 | A | 11/2009 |
| KR | 10-2006-0071215 | | 6/2006 |

* cited by examiner

*Primary Examiner* — Lindsay Low
*Assistant Examiner* — Charles Brauch
(74) *Attorney, Agent, or Firm* — Morgan, Lewis & Bockius LLP

(57) ABSTRACT

A cylinder block including a water jacket for maintaining an engine at a proper temperature during operation thereof may include a plurality of cylinders formed within the cylinder block so that a number of pistons are respectively inserted into the cylinders, and a heat sink formed in the water jacket provided to enclose side surfaces of the plural cylinders.

8 Claims, 2 Drawing Sheets

CYLINDER BLOCK

CROSS-REFERENCE(S) TO RELATED APPLICATIONS

The present application claims priority to Korean Patent Application No. 10-2014-0030035, filed on Mar. 14, 2014, which is incorporated herein by reference in its entirety.

BACKGROUND OF THE INVENTION

1. Field of the Invention

Exemplary embodiments of the present invention relate to a cylinder block, particularly, to a cylinder block capable of improving cooling performance and fuel efficiency of an engine by forming a heat sink in a water jacket provided within the cylinder block.

2. Description of Related Art

A vehicle engine is aimed at improving fuel efficiency and performance by increasing cooling efficiency of a cooling system thereof all over the world. In a case of raising output of a water pump or increasing an amount of cooling water in order to enhance the cooling efficiency, there is a problem in that fuel efficiency of the engine is deteriorated since driving torque is increased and an additional load is applied to the engine. On the contrary, in a case of lowering output of the water pump or decreasing an amount of cooling water in order to enhance fuel efficiency, there is a problem in that cooling performance of the engine is deteriorated.

Meanwhile, an HPDC (HIGH PRESSURE DIE CASTING), which is a method of manufacturing a typical cylinder block, has a difficulty in manufacturing a cylinder block having different mixed materials using a core due to the nature in which high pressure is applied to a cast during casting the cylinder block. However, when a slat core is applied to the HPDC, the cylinder block having different mixed materials is expected to be manufactured.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cylinder block capable of simultaneously improving cooling efficiency and fuel efficiency by additionally forming a heat sink in a water jacket.

Other objects and advantages of the present invention can be understood by the following description, and become apparent with reference to the exemplary embodiments of the present invention. Also, it is obvious to those skilled in the art to which the present invention pertains that the objects and advantages of the present invention can be realized by the device as claimed and combinations thereof.

In accordance with an exemplary embodiment of the present invention, a cylinder block including a water jacket for maintaining an engine at a proper temperature during operation thereof, includes a plurality of cylinders formed within the cylinder block so that a number of pistons are respectively inserted into the cylinders, and a heat sink formed in the water jacket provided to enclose side surfaces of the plural cylinders.

The heat sink may be formed a portion of upper sides of the plural cylinders, the heat sink may have a band shape and be continuously formed along width directions of the plural cylinders, the heat sink may have a curvature formed along surfaces of the cylinders and be bent such that a rectangular concavo-convex structure is continuously formed along the width directions of the plural cylinders, and the water jacket may be formed to be capable of communicating with a water jacket provided to cylinder heads mounted above the cylinders.

The water jacket may be divided into a first water jacket enclosing sides of the cylinders in width directions thereof and a second water jacket enclosing the other sides of the cylinders in the width directions thereof, an inlet may be extendedly formed through which cooling water is introduced from one side of the first water jacket to the water jacket, an outlet may be extendedly formed through which the cooling water in the water jacket is discharged from one side of the second water jacket, and the heat sink may be formed in each of the first and second water jackets.

The water jacket and the heat sink may have different materials from each other, and the heat sink may be cast simultaneously with the water jacket using a salt core.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
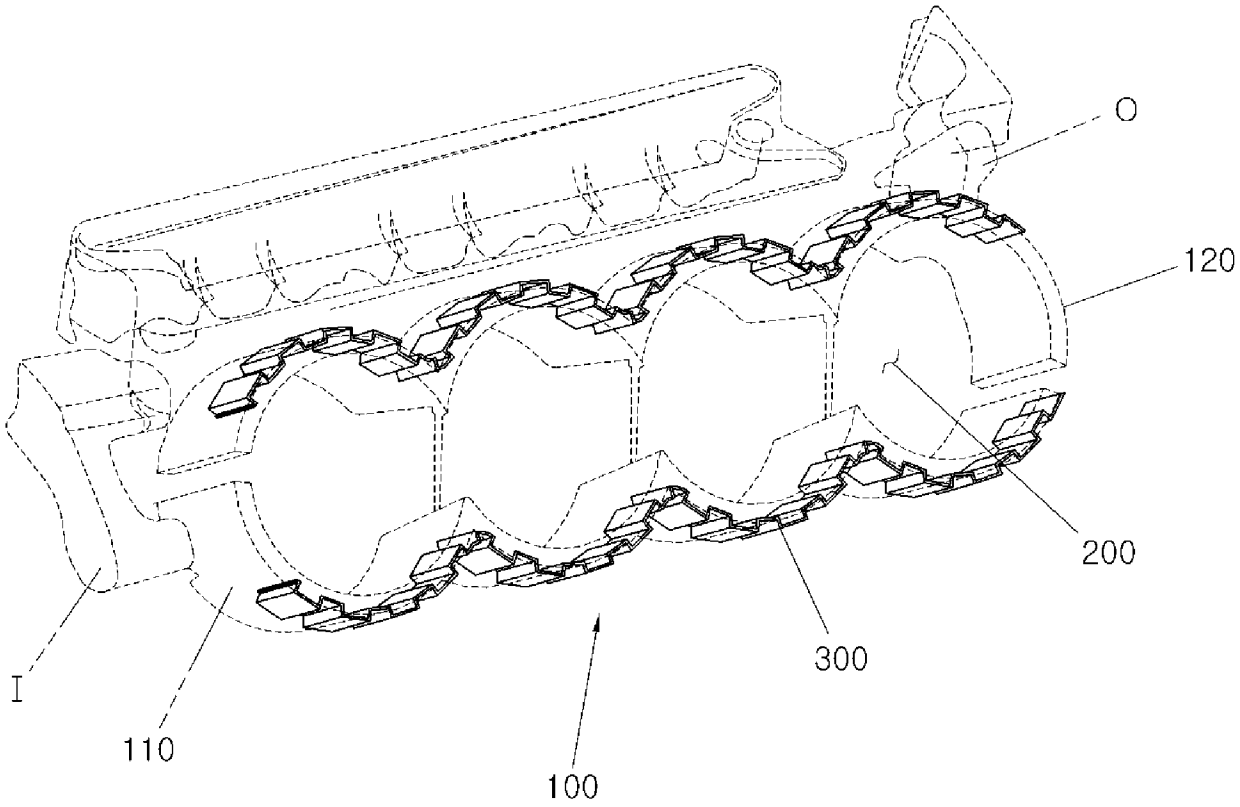
FIG. 1 is a perspective view illustrating a cylinder block according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
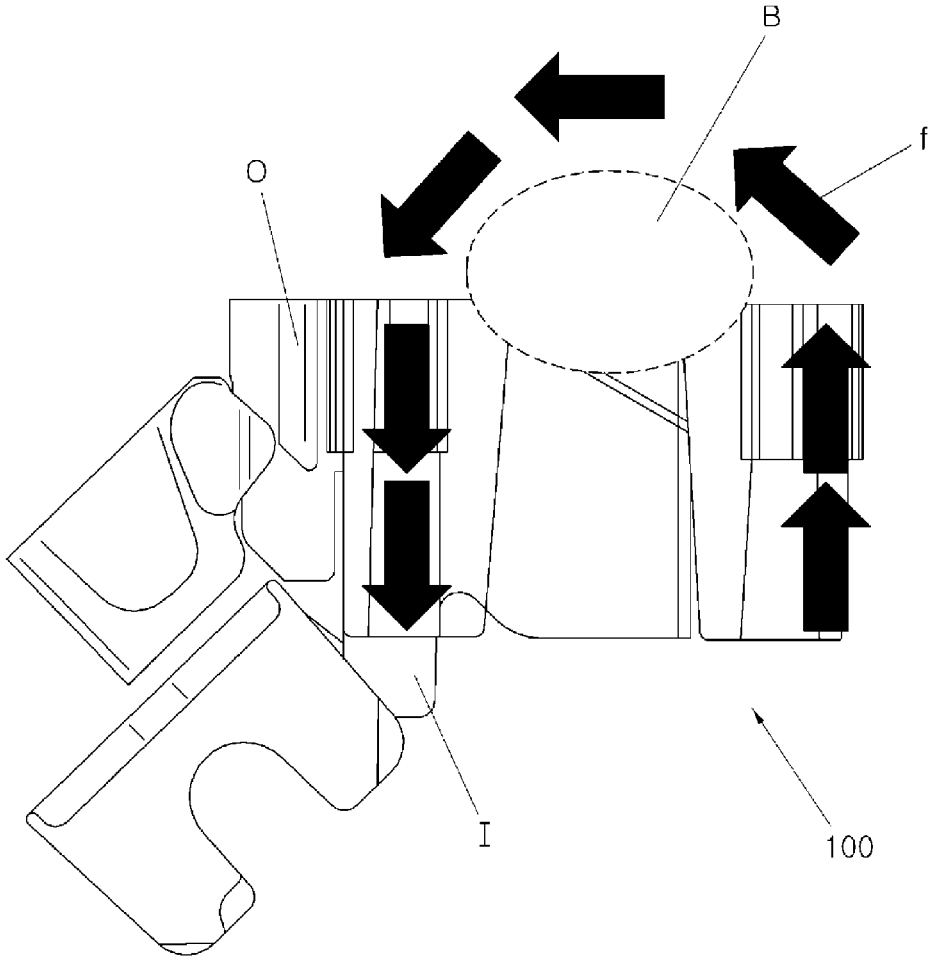
FIG. 2 is a cross-sectional view illustrating a principal part of the cylinder block in FIG. 1.

FIG. 1 is a perspective view illustrating a cylinder block according to an exemplary embodiment of the present invention. FIG. 2 is a cross-sectional view illustrating a principal part of the cylinder block in FIG. 1.

As shown in FIGS. 1 and 2, the cylinder block according to the exemplary embodiment of the present invention including a water jacket 100 for maintaining an engine at a proper temperature during operation thereof includes a plurality of cylinders 200 formed within the cylinder block so that a number of pistons are respectively inserted into the cylinders 200 and a heat sink 300 formed in the water jacket 100 provided to enclose side surfaces of the plural cylinders 200.

In an exemplary embodiment of the present invention, the heat sink 300 is formed a portion of upper sides of the plural cylinders 200. The heat sink 300 has a band shape and is continuously formed along width directions of the plural cylinders 200.

In this case, the heat sink 300 has a curvature formed along surfaces of the cylinders 200 and has a stepped cross-section configured by being bent such that a rectangular concavo-convex structure is continuously formed.

Since the heat sink 300 has the stepped cross-section, a heat transfer surface area thereof is maximized so that heat transfer from the heat sink 300 to cooling water is maximized.

In addition, the water jacket 100 is formed to be capable of communicating with a water jacket provided to cylinder heads mounted above the cylinders 200. The water jacket 100 is divided into a first water jacket 110 enclosing sides of the cylinders 200 in the width directions thereof and a second water jacket 120 enclosing the other sides of the cylinders 200 in the width directions thereof.

An inlet I is extendedly formed through which cooling water is introduced from one side of the first water jacket 110 to the water jacket 100, and an outlet O is extendedly formed through which the cooling water in the water jacket 100 is discharged from one side of the second water jacket 120.

That is, cooling water is introduced into the first water jacket 110 through the inlet I, is moved to the water jacket through the first water jacket 110, and is then discharged through the extended outlet O from the second water jacket 120.

The heat sink 300 is formed in each of the first and second water jackets 110 and 120 to maximally receive heat generated in a combustion chamber B, namely in a space between the uppermost end of each of the cylinders 200 and the associated cylinder head.

The heat transferred to the heat sink 300 is transferred to cooling water moving between the water jacket 100 and another water jacket and is then transferred to the outside via a cooling system.

The cylinder block having the above configuration according to an exemplary embodiment of the present invention is manufactured such that the water jacket 100 and the heat sink 300 have different materials from each other, in order to transfer more heat to the heat sink 300. That is, the present invention selects a material such that the heat sink 300 has a heat transfer coefficient larger than the water jacket 100.

In addition, the cylinder block of the present invention is manufactured such that the heat sink 300 is cast simultaneously with the water jacket 100 using a salt core.

Since the cylinder block is cast such that the heat sink 300 is formed in the water jacket 100 using the salt core, the cylinder block applying the techniques of the present invention may be manufactured without a considerable change in a production line of the cylinder block according to the related casting method. Thus, it may be possible to reduce production costs and increase productivity.

In addition, since the heat sink 300 may be formed in an inner space of the water jacket 100 without restriction on an installation position, the heat sink 300 may be formed in the vicinity of the high-temperature combustion chamber or in a part in which cooling must be greatly performed. Consequently, cooling may be locally performed and cooling efficiency may be increased.

Ultimately, in accordance with the present invention, it may be possible to improve cooling performance without an increase in a capacity of an additional water pump and thus improve fuel efficiency of an internal combustion engine.

In accordance with a cylinder block according to the exemplary embodiments of the present invention, it may be possible to improve cooling efficiency of the cylinder block without an increase in a capacity of a water pump or an amount of cooling water.

In addition, it may be possible to enhance the cooling efficiency by mounting a heat sink to a part to which heat is relatively significantly transferred. That is, it may be possible to intensively cool a combustion chamber.

In addition, since the heat sink is cast simultaneously with a water jacket via a salt core method, the heat sink may be simply formed.

Moreover, since the cooling efficiency is enhanced without an increase of an additional load for circulation of cooling water, fuel efficiency of an engine may be improved.

Furthermore, since the heat sink may be formed in the water jacket without a considerable change in a casting method of manufacturing an existing cylinder block, the present invention may be simply applied thereto and have high productivity.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder block including a water jacket for maintaining an engine at a proper temperature during operation thereof, comprising:

a plurality of cylinders formed within the cylinder block so that pistons are respectively inserted into the cylinders; and, a heat sink formed in the water jacket and enclosing side surfaces of the plural cylinders, wherein the heat sink has a band shape and is continuously formed along outer surfaces of the plural cylinders, wherein the heat sink has a curvature formed along the outer surfaces of the cylinders and is bent in a shape such that a plurality of rectangular concave-convex structures is continuously adjacent to each other along the outer surfaces of the plural cylinders, and each of the rectangular concave-convex structures of the heat sink has a stepped cross-section and each said stepped cross-section is in a shape of alternatively protruding towards the outer surfaces of the plural cylinders and protruding outwards of the outer surfaces of the plural cylinders, so that heat transfer from the heat sink to cooling water is maximized, and wherein the heat sink has a heat transfer coefficient larger than the water jacket.

2. The cylinder block of claim 1, wherein the heat sink is formed at a portion of upper sides of the plural cylinders.

3. The cylinder block of claim 1, wherein the water jacket is formed to communicate with a water jacket provided to cylinder heads mounted above the cylinders.

4. The cylinder block of claim 1, wherein the water jacket is divided into a first water jacket enclosing sides of the cylinders in width directions thereof and a second water jacket enclosing the other sides of the cylinders in the width directions thereof.

5. The cylinder block of claim 4, wherein an inlet is extendedly formed through which cooling water is introduced from one side of the first water jacket to the water jacket; and, wherein an outlet is extendedly formed through which the cooling water in the water jacket is discharged from one side of the second water jacket.

6. The cylinder block of claim 4, wherein the heat sink is formed in each of the first and second water jackets.

7. The cylinder block of claim 1, wherein the water jacket and the heat sink have different materials from each other.

8. The cylinder block of claim 1, wherein the heat sink is cast simultaneously with the water jacket using a salt core.

* * * * *